US012290190B2

(12) United States Patent
Ward

(10) Patent No.: US 12,290,190 B2
(45) **Date of Patent: *May 6, 2025**

(54) ART DISPLAY BOX

(71) Applicant: Genesis Skawski Ward, Colorado Springs, CO (US)

(72) Inventor: Genesis Skawski Ward, Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/402,218

(22) Filed: Jan. 2, 2024

(65) Prior Publication Data

US 2024/0306826 A1 Sep. 19, 2024

Related U.S. Application Data

(63) Continuation of application No. 17/122,553, filed on Dec. 15, 2020, now Pat. No. 11,857,092.

(60) Provisional application No. 62/948,457, filed on Dec. 16, 2019.

(51) Int. Cl.
*A47G 1/12* (2006.01)

(52) U.S. Cl.
CPC ..... *A47G 1/12* (2013.01)

(58) Field of Classification Search
CPC ..... A47G 1/12; A47G 2001/0072; A47G 1/0616; G09F 7/04; A47F 3/00; A47F 3/005
USPC ..... 206/769–774; 312/114, 245
See application file for complete search history.

(56) References Cited

U.S. PATENT DOCUMENTS

| | | | | |
|---|---|---|---|---|
| 1,838,215 | A * | 12/1931 | De Clairmont | A01K 63/003 119/248 |
| 4,709,495 | A * | 12/1987 | Buckwalter | A47G 1/12 40/661 |
| 4,850,125 | A * | 7/1989 | Green | A47G 1/0605 40/799 |
| 5,157,852 | A * | 10/1992 | Patrou | G09F 1/08 40/124.19 |
| 6,889,458 | B2 * | 5/2005 | Copley | A47G 1/0616 40/711 |
| 9,032,654 | B2 * | 5/2015 | Wilcoxen | A63F 1/02 40/766 |
| D759,981 | S * | 6/2016 | Roper | D6/300 |
| 2012/0169718 | A1 * | 7/2012 | Schindler | G02B 30/52 345/419 |

* cited by examiner

*Primary Examiner* — Cassandra Davis

(57) ABSTRACT

An art display box configured for storing, transporting, examining, and displaying pieces of artwork, such as nail art. The art display box includes transparent panels for viewing of the artwork from multiple views and a mounting plate for securely and removably affixing pieces of the artwork for shipment, handling, and evaluation. To further protect the pieces of artwork, the art display box provides a set of stoppers to maintain a predetermined gap between the mounting plate and the interior surface of a front panel.

19 Claims, 5 Drawing Sheets

ART DISPLAY BOX

CROSS-REFERENCE TO RELATED APPLICATIONS

This application is a continuation of U.S. patent application Ser. No. 17/122,553, filed on Dec. 15, 2020, the entire disclosure of which is hereby incorporated by reference in its entirety.

BACKGROUND

Traditionally, artists may create artwork with various media and may place the artwork in frames, boxes, or other structures, for display and/or competition. There has been an increasing interest for designing, creating, and displaying nail art pieces for both private and competitive viewing. Nail art may comprise, for example, artwork that is created on an artificial nail canvas. Competitions may involve artists submitting the nail art for examination by judges, for example. While some of nail art may be fragile to handle, the artists may often need to store, transport, and/or ship the artwork to the competitions. For purposes of evaluating the nail art according to the criteria of the competition, the judges may need to remove and handle the nail art. Thereafter, the nail art may return shipped to the artists. Aside from a competition, the artists may sell or otherwise publicly or privately display the artwork by hanging it on a wall or placing it on a table or other surface, for example.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

According to the present disclosure, the above and other issues are resolved by providing an art display box, and in some aspects, a art display box. The art display box is enclosed on all sides, including non-opaque or transparent panels in the front, the back, and the four sides. In this way, the display box provides a clear view of the art pieces stored inside the box and, in some examples, an information card regarding the art pieces. The back panel of the art display box slides in and out along guides or channels for opening and closing the art display box. The art display box further comprises a mounting plate for attaching one or more pieces of art. The mounting plate may be inserted into the art display box such that it is substantially parallel to the front and back panels. In some examples, the mounting plate may be comprised of or associated with a fastening material for securely and removably affixing pieces if the art to the mounting plate. For example, the fastening material may be an adhesive, a magnetized material, or other suitable material for securely and removably affixing the pieces of art to the mounting plate. In some embodiments, the mounting plate may be transparent; whereas in other embodiments, the mounting plate may be opaque.

In further aspects, the art display box may be placed into the art display box by positioning the mounting plate in parallel to the front panel. The mounting plate may be made of a magnetized material for securely attaching pieces of the nail art on the mounting plate. The art display box may include one or more transparent blocks that are attached to interior side corners of the art display box. The back panel touches the blocks upon placing into the art display box. The blocks maintain a distance between the front panel of the art display box and the mounting plate. The distance prevents the set of nail art from being crushed between the mounting plate and the front panel. All the panel of the art display box, including the back panel, may be transparent for providing clear views on the set of nail art inside the art display box.

This Summary is provided to introduce a selection of concepts in a simplified form, which is further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the following description and, in part, will be apparent from the description, or may be learned by practice of the disclosure.

BRIEF DESCRIPTIONS OF THE DRAWINGS

Non-limiting and non-exhaustive examples are described with reference to the following figures.

Figure 4A:
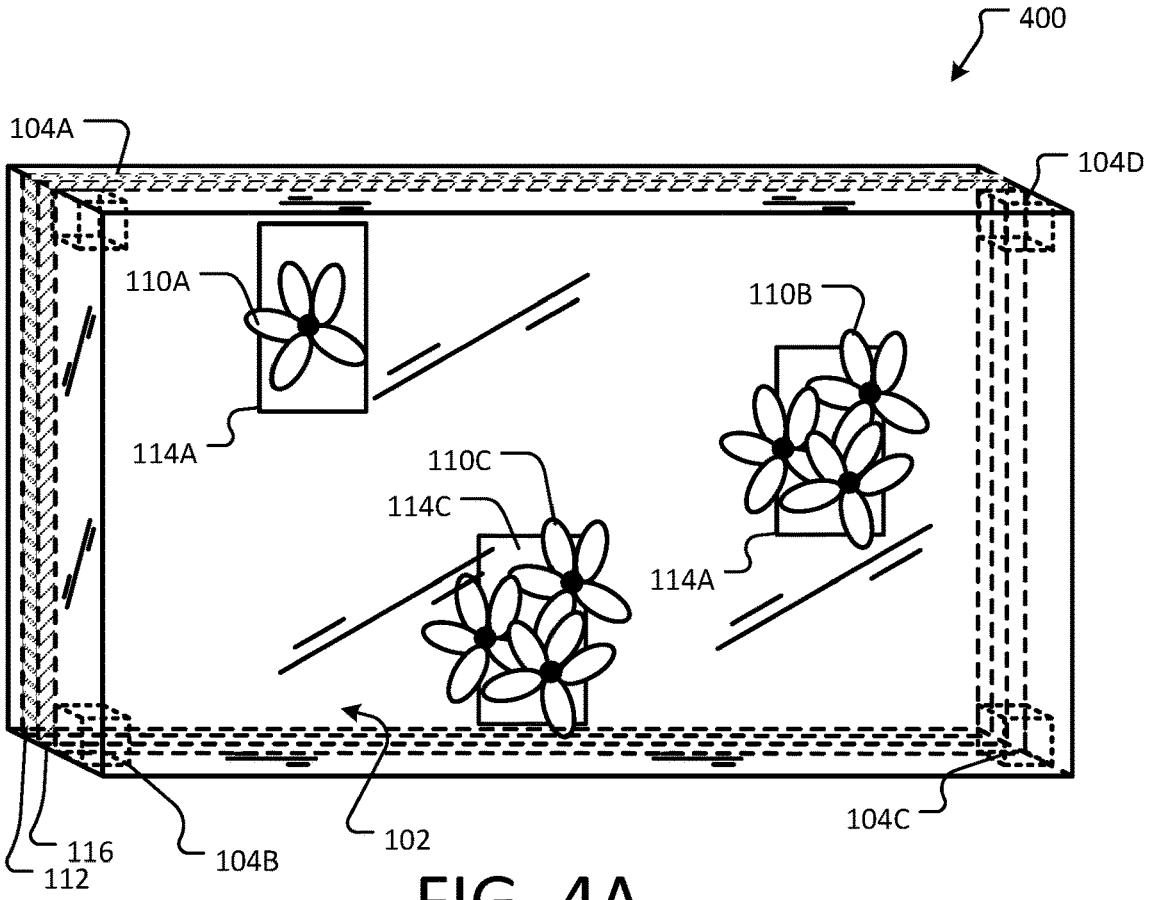
Figure 4B:
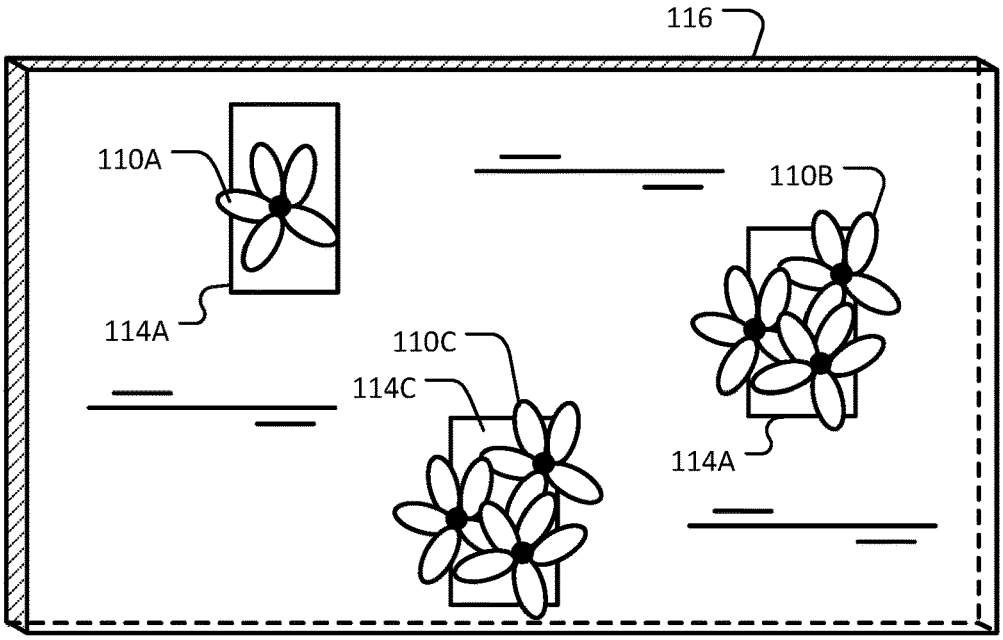

FIGS. 4A-B illustrate an example apparatus from a front view in accordance with aspects of the present disclosure.

Figure 5:
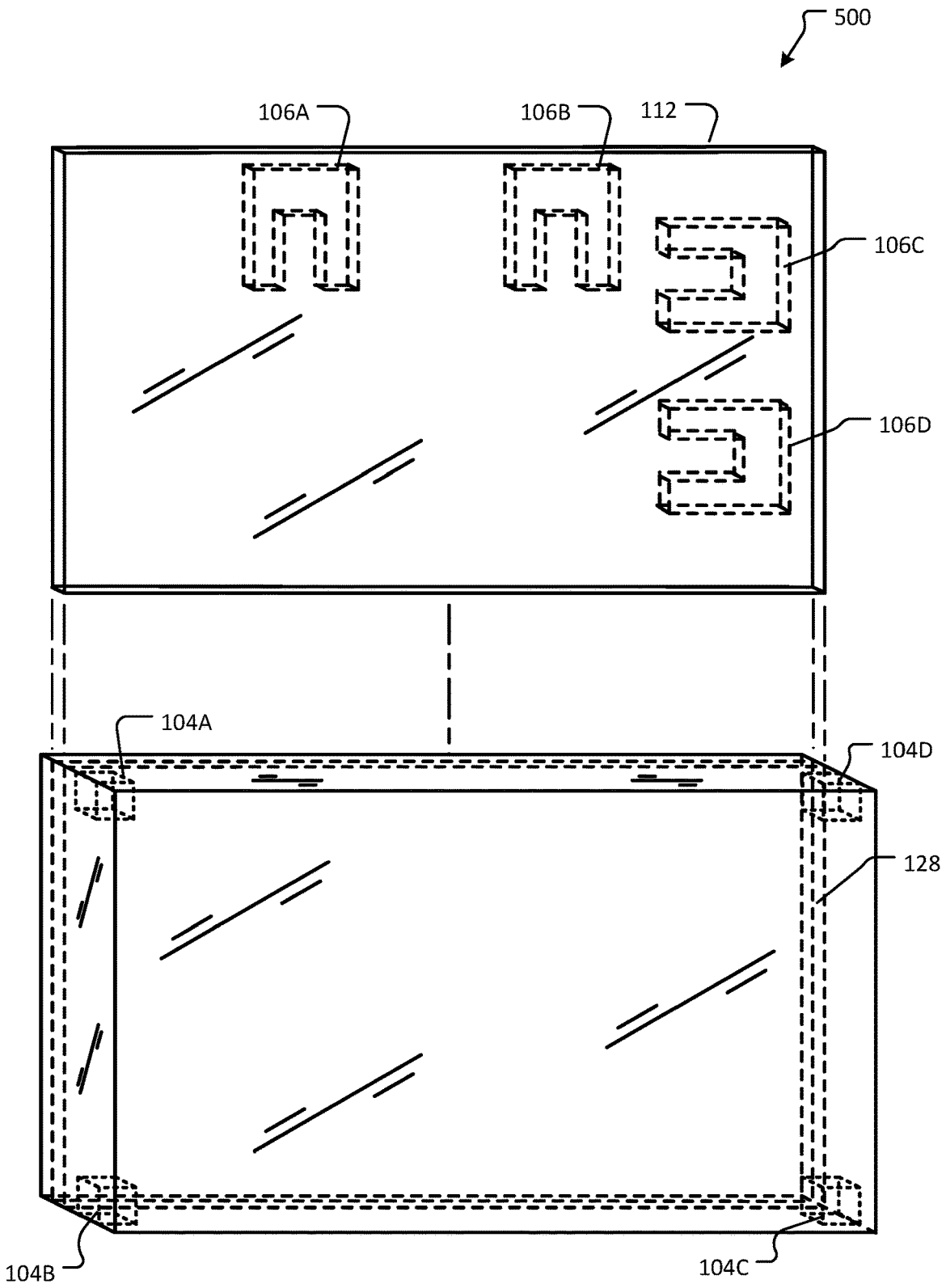

FIG. 5 illustrates an example apparatus from a front view in accordance with aspects of the present disclosure.

Figure 6:
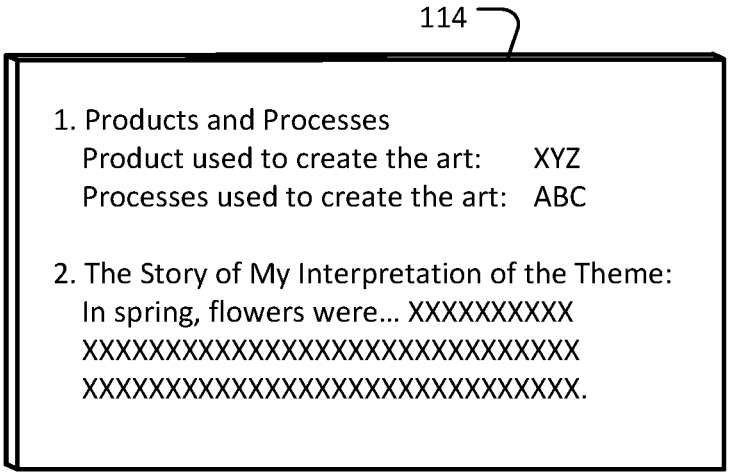

FIG. 6 illustrates an example of an information card of the artwork in accordance with aspects of the present disclosure.

Figure 7:
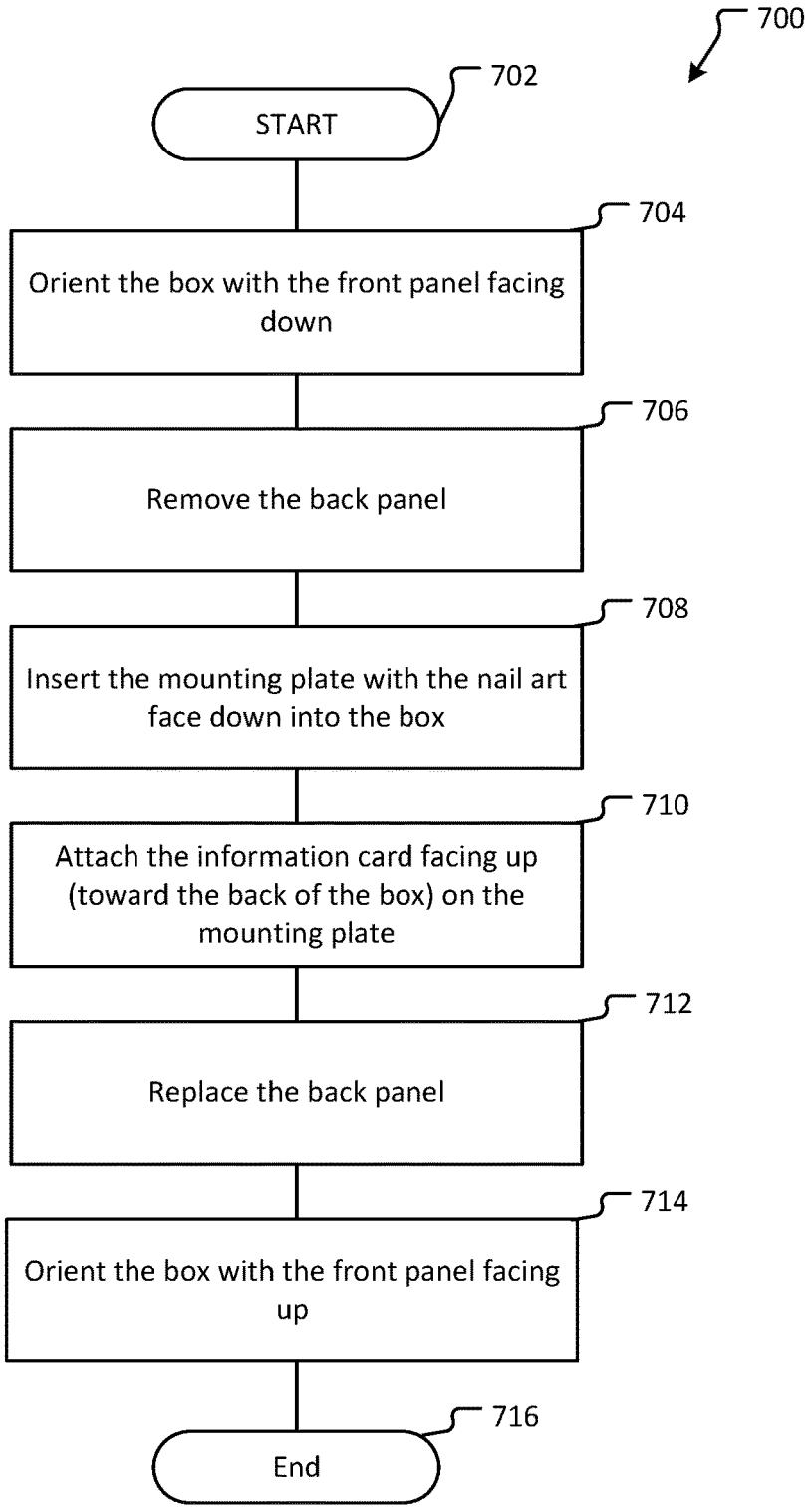

FIG. 7 illustrates an example method of using an art display box in accordance with aspects of the present disclosure.

DETAILED DESCRIPTION

Various aspects of the disclosure are described more fully below with reference to the accompanying drawings, which from a part hereof, and which show specific example aspects. However, different aspects of the disclosure may be implemented in many different ways and should not be construed as limited to the aspects set forth herein; rather, these aspects are provided so that this disclosure will be thorough and complete, and will fully convey the scope of the aspects to those skilled in the art. Aspects may be practiced as methods, systems or devices. Accordingly, aspects may take the form of a hardware implementation, an entirely software implementation or an implementation combining software and hardware aspects. The following detailed description is, therefore, not to be taken in a limiting sense.

The present disclosure relates to an apparatus, an art display box in particular, for storing, transporting, examining, and displaying pieces of art. In aspects, the art display box may further be configured to store, transport, examine, and display nail art. There has been an increasing interest in designing, creating, and displaying nail art pieces for both private and competitive viewing. The nail art may comprise an artificial nail canvas upon which the artwork is conveyed and/or affixed for display purposes. Competitions involve artists submitting the nail art for examination by judges, for example. While some of nail art may be fragile to handle, the artists may often store, transport, and ship the artwork to the competitions. For purposes of evaluating the nail art according to the criteria for the competition, the judges may need to remove and handle the nail art. Thereafter, the nail art may be return shipped to the artists. Aside from competition, the artists may sell or otherwise publicly or privately display the artwork by hanging it on a wall or placing it on a table or other surface, for example. As described further herein, a specialized box is provided for conveniently and safely storing, transporting, examining, and displaying pieces of artwork that is useful to artists, consumers, judges, or other professionals involved in nail art or other artistic endeavors.

As discussed in more details below, the present disclosure relates to an art display box, and in particular, the art display box for storing, transporting, examining, and displaying pieces of nail art both conveniently and safely. The art display box according to the present disclosure enables the artists to conveniently open and close the box, to securely place pieces of nail art inside the box for transportation while preventing the pieces of nail art from shifting during the transportation. The art display box enables displaying exhibiting the pieces of the nail art placed inside the box, viewable from the top and the sides directions. The art display box also displays information and description about the art work through the back panel.

Figure 1:
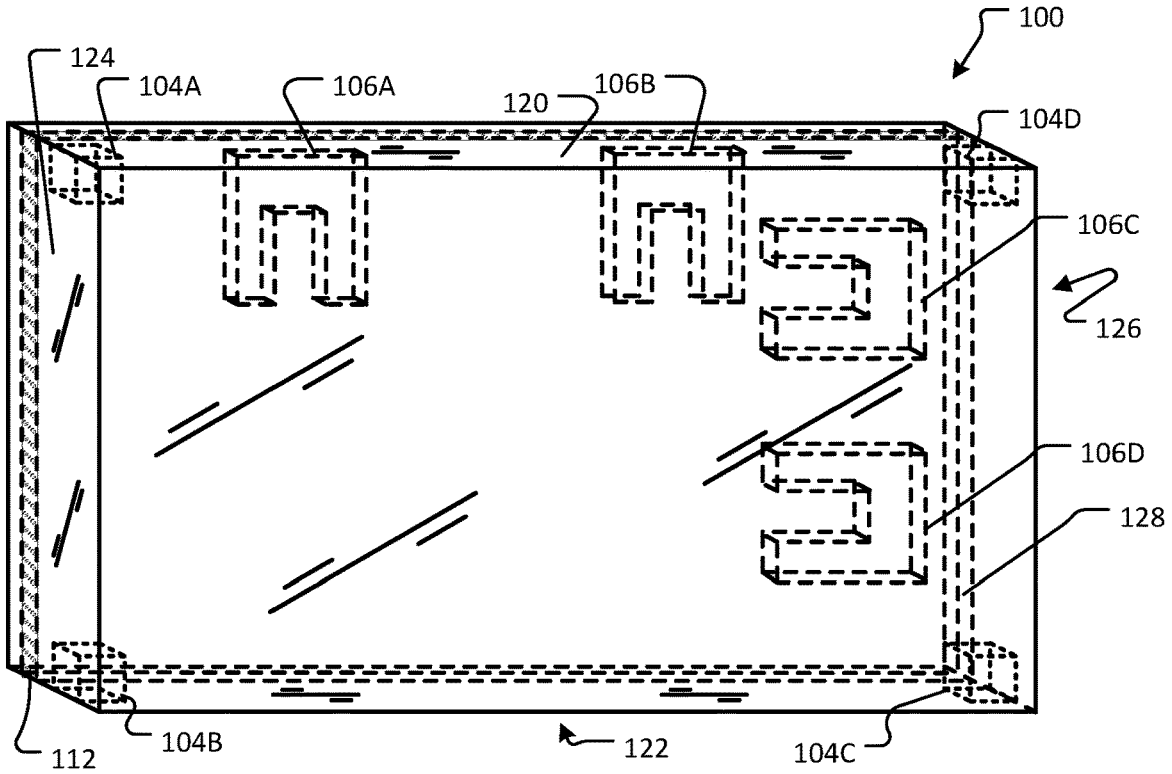
FIG. 1 illustrates an example apparatus from a front view in accordance with aspects of the present disclosure.

FIG. 1 illustrates an example art display box from a front view in accordance with aspects of the present disclosure. The art display box 100 is an apparatus comprising six panels. Illustrated in a landscape orientation, the six panels include: a front panel 102, a back panel 112, a top panel 120, a bottom panel 122, a left panel 124, and a right panel 126, for example. A number of panels and surfaces of the art display box 100 according to the present disclosure is not limited to six. In some aspects, one or more of the surfaces of the panels may be curved. In aspects, at least one of the six panels of the art display box 100 may be movable for opening and closing the box. The back panel 112 may be movable, for example. In aspects, the back panel 112 may slide along guides, channels, or concaved paths (e.g., guide 128) inside the left panel 124 and/or the right panel 126. In aspects, the back panel 112 may slide downward from above the art display box 100. Additionally or alternatively, the back panel 112 may slide upward from beneath the art display box 100. In some other aspects, the guides may be the interior surfaces of the top panel and/or the bottom panel, allowing the back panel 112 to slide in and out sideways. The art display box 100 in FIG. 1 illustrates the back panel 112 fit in the guides or channels along the back edge of the left side panel 124 and right side panel 126. In aspects, the guides or the channels may be located on three side panels. In yet some other aspects, the back panel 112 may snap into the side panels with tabs or protruding parts (not shown).

All six panels and the stoppers 104A-D of the box may be non-opaque or transparent, made of acrylic, polycarbonate materials, or glass, for example. The non-opaque or transparent panels and the stoppers enable viewing the artwork from front, top, bottom, left, and right views and viewing the information card from the back of the art display box 100. FIG. 1 illustrates the art display box 100 with the back panel 112 but without installing a mounting plate. The back panel 112 is shown with the mounting plate 116 from a left side view in FIG. 3

In aspects, all the six panels may be transparent or at least enables a user to see the artwork through at least a front view through the front panel 102, from a top view through the top panel 120, from a bottom view through the bottom panel 122, from a left view through the left panel 124, from a right view through the right panel 126, and from a back view through the back panel 112 (e.g., when the mounting plate 116 is transparent and there is no information card 114 installed). In aspects, when the information card 114 is installed on the back surface of the mounting plate 116 (whether or not the mounting plate 116 is transparent), the information card 114 is viewable from the back view of the art display box 100 through the transparent back panel 112.

Hooks 106A-B enable the art display box to be hang on the wall in a landscape orientation. Hooks 106C-D enable the art display box to be hang on the wall in a portrait orientation. The hooks 106A-D are attached to the back side of the back panel 112. The hooks 106A-D may include an area for interlocking a screw or supporting a nail with the back side of the art display box 100. Additionally or alternatively, the art display box 100 may include hooks in different orientations for hanging the art display box 100 in a portrait or a landscape orientation. In aspects, the hooks 106A-D may take forms of keyholes and brackets. In some other aspects a number of the hooks 106A-D may be one per orientation or any other number than four. In yet some other aspects, the art display box 100 may be without the hook.

As illustrated, the art display box 100 includes four stoppers 104A-D that maintain the mounting plate 116 at a distance from the front panel 102 to prevent pieces of art affixed to the mounting plate 116 from being crushed against the interior front surface of the box. Although four stoppers 104A-D are shown, more or fewer stoppers may be provided to maintain the distance of the mounting plate 116 from the front panel 102. Additionally, the distance may be any suitable distance greater than a height of the pieces of artwork when affixed to the mounting plate 116. In aspects, the four stoppers 104A-D are non-opaque or transparent to prevent obstructing a view of the pieces of the artwork. In aspects, the four stoppers 104A-D may be fixed inside the art display box 100. In some other aspects, the four stoppers 104A-D may be movable to adjust the distance from the interior surface of the front panel 102 and the mounting plate 116, e.g., to account for different heights of pieces of artwork affixed to the mounting plate 116. When the mounting plate 116 is inside the display art box 100, the mounting plate 116 rests against the four stoppers 104A-D between the back panel 112 and the four stoppers 104A-D within the art display box 100.

In aspects, the stoppers 104A-D may be placed at four side joints between the four side panels at a predetermined distance or gap, one inch for example, from the interior surface of the front panel 102. The gap may be associated with rules of an art competition, such as a nail art competition, which may set a maximum height of the artwork, a maximum height of one inch, for example. In aspects, use of the art display box 100 enables checking the maximum height of the artwork by ensuring that the artwork does not touch the interior surface of the front panel 102. Accordingly, the art display box 100 provides a convenient way for the designer to check compliance with the maximum height rule. By installing the artwork without touching the interior surface of the front panel, the art display box 100 may be useful in preventing the artwork from being disqualified based on the maximum height requirement. In some other aspects, positioning of the stoppers 104A-D may be adjustable to accommodate a gap other than one inch, for different competition rules or for display, for example.

As should be appreciated, the various methods, devices, applications, features, etc., described with respect to FIG. 1 are not intended to limit the apparatus 100 to being performed by the particular applications and features described.

Accordingly, additional configurations may be used to practice the methods and systems herein and/or features and applications described may be excluded without departing from the methods and systems disclosed herein.

Figure 2:
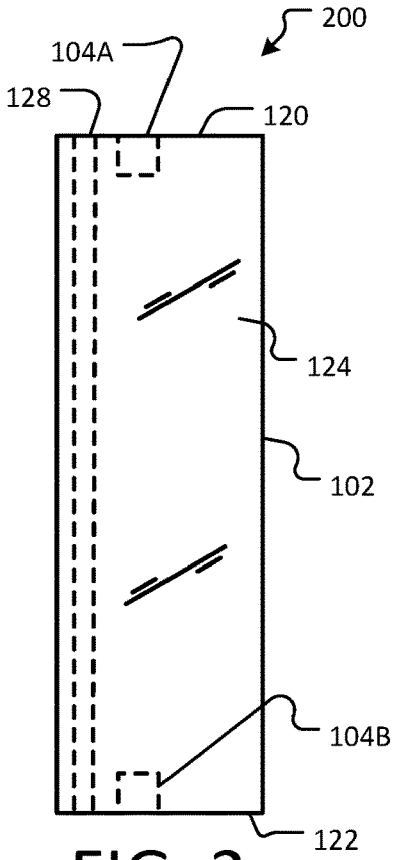
FIG. 2 illustrates an example apparatus from a left side view in accordance with aspects of the present disclosure.

FIG. 2 illustrates an example apparatus from a left side view in accordance with aspects of the present disclosure. The apparatus is an art display box 200 (substantially the same as the art display box 100) viewed from a left side. In this case, the left side view is a view of the art display box 200 through the transparent left panel 124. In particular, FIG. 2 shows the art display box 200 without a back panel (e.g., back panel 112) or a mounting plate (e.g., mounting plate 116) inserted inside the art display box 200. FIG. 2 illustrates the left side view of the top panel 120 and the bottom panel 122. The stoppers 104A-B are located inside the art display box 200. A guide 128 is illustrated on the left panel 124, on an interior surface of the left panel 124 (e.g., on a side opposite of the left view) inside the art display box 200. The guide 202 enables the back panel 112 to slide in and out of the art display box 200.

Figure 3:
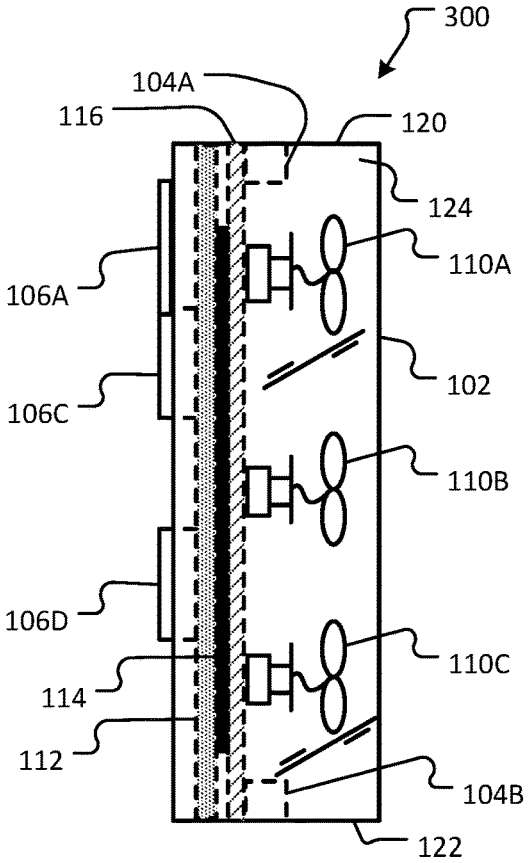
FIG. 3 illustrates an example apparatus with the artwork from a left side view in accordance with aspects of the present disclosure.

FIG. 3 illustrates an example apparatus that is an art display box 300 (substantially the same as art display box 100) from the left side view. In this case, the mounting plate 116 is placed against stoppers 104A-B (the stoppers that are visible from the left side view). Additionally, pieces of artwork 110A-C are affixed to the mounting plate 116, in accordance to aspects of the present disclosure. In particular, FIG. 3 illustrates the art display box 100 with the front panel 102, the artwork 110A-C, the mounting plate 116, the information card 114, and the back panel 112 installed. In aspects, the left panel 124 is transparent, allowing a left side view of the artwork 100A-C affixed to the mounting plate 116. The back panel 112 includes the hooks 106A, C, D (e.g., the hooks visible from the left side view). The information card 114 is placed between the back panel 112 and the mounting plate 116. In aspects, one or more information cards 114 include descriptions of the artwork and are placed facing toward the back panel 112 of the art display box 200. Since the back panel 112 is transparent, the one or more information cards 114 are visible through the back panel 112 from the back view of the art display box 200. In aspects, the one or more information cards 114 may describe the artwork 110A-C individually or collectively, may describe materials used for creating artwork 110A-C, may describe methods for making the artwork 110A-C, and/or may otherwise provide information in compliance with rules of a competition. As illustrated, the mounting plate 116 is placed against the stoppers 104A-B.

FIG. 4A illustrates an example art display box 400 from a front view through transparent front panel 102, in accordance with aspects of the present disclosure. In this case, the three pieces of artwork 110A-C are affixed on the mounting plate 116 and are visible through front panel 112 within the art display box 400. In this case, the mounting plate 116 is also transparent and information cards 114A-C are visible behind artwork 110A-C. In other examples, the mounting plate 116 may be opaque and, while artwork 110A-C would be visible from the front view through front panel 102, information cards 114A-C would not be visible from the front view. However, such information cards 114A-C would be visible through transparent back panel 112. As illustrated, the mounting plate 116 rests on stoppers 104A-D between the back panel 112 and the front panel 102, thereby preventing artwork 110A-C from touching and/or being crushed against the front panel 102.

FIG. 4B illustrates mounting plate 116 including artwork 110A-C affixed thereon, in accordance with aspects of the disclosure. In this case, the mounting plate 116 has not been installed into art display box 400. As with FIG. 4A, mounting plate 116 is transparent and, although information cards 114A-C are affixed to a back side of mounting plate 116, the information cards 114A-C are visible from a front view through mounting plate 116.

In aspects, the pieces of artwork 110A-C may be securely and removably affixed to mounting plate 116 by magnets, for example. In some examples, the mounting plate 116 may be made of a magnetized material. A matting material, such as cloth or cardboard, may be affixed to the magnetized material to provide an aesthetic backing for the artwork 110A-C. Alternatively, the mounting plate 116 may be made of a smooth, non-stick material, such as glass, acrylic or plastic, for example. In this case, the mounting plate 116 may be transparent. Bases of the respective pieces of artwork 110A-C may also include a magnetized material for affixing in any position on the mounting plate 116. Alternatively, the mounting plate 116 may be made of other suitable materials, such as glass, acrylic or plastic, for example. In this case, the mounting plate 116 may be transparent. The bases of the respective pieces of artwork 110A-C may include a temporary binding material (e.g., tape, sticker, or temporary adhesive) for affixing the respective pieces of artwork 110A-C in any position on the mounting plate 116. In still other aspects, the mounting plate 116 may be covered with a textured material for affixing pieces of artwork comprising a Velcro®-like binding surface. In this way, securely and removably affixing the pieces of artwork 110A-C to the mounting plate 116 may prevent the pieces of artwork 110A-C from shifted upon transporting the art display box 400. Accordingly, the art display box 400 may be shipped (e.g., to a competition) and carried, held or manipulated (e.g., during examination) without the pieces of artwork 110A-C becoming dislodged from the mounting plate 116. Even so, the pieces of artwork 110A-C may be readily and easily removed from the mounting plate 116, if desired. Thus, use of the art display box 400 according to the present disclosure enables an art creator to display artwork safely while at the same time enabling judges or other consumers to easily view and/or touch the artwork.

In some aspects, an art designer may also satisfy competition rules for judging the artwork. In aspects, rules may require the artwork (e.g., ten pieces in a set of nail art) to be of a certain size and independently manipulable by judges (e.g., as individual pieces without being permanently secured to one another or to any medium). Thus, the artwork must be securely but temporarily (or removably) affixed to the mounting plate 116 to enable the judges to remove and hold individual pieces (e.g., of a set of ten pieces of nail art) from the art display box 400. The mounting plate 116 being made of a magnetized or other suitable material (e.g., glass, acrylic, textured) enables both secure attachment and easy removal of the individual pieces of artwork, as well as enabling placement of the artwork in any desirable layout on the mounting plate 116. The specialized mounting plate 116 further prevents the artwork from being dislocated or damaged while transporting the art display box 400. In aspects, use of the specialized mounting plate 116 for securely and temporarily affixing the pieces of the artwork is superior than use of glue, which more permanently secures the pieces. In this case, judges during a competition may encounter difficulties removing or replacing the pieces of artwork during examination. The attachments by use of magnets or other temporary fixators (e.g., tape, sticker, Velcro®) prevent such difficulties. Other competition rules may also be easily satisfied by art display box 400, including but not limited to securely fastening the artwork to a plain (e.g., color, no texture, and no mirror), flat surface. Some rules may require the mounting surface of the artwork to be flat, flush, and sturdy. Some other rules may require the artwork not to be attached to the bottom of the box for submission. According to the present disclosure, the mounting plate 116 is flat, flush, and sturdy and is distinct from the back panel 112 of the art display box 400 to satisfy the exemplar rules.

In aspects, the mounting plate 116 may be placed inside the art display box 400 by removing the back panel 112 and placing the mounting plate 116 against the stoppers 104A-D from the back of the art display box 400. After placing the mounting plate 116, the back panel 112 may be inserted in along the guides into the art display box 400.

FIG. 5 illustrates an example art display box 500 from the front view, in accordance with aspects of the present disclosure. FIG. 5 illustrates the back panel 112 and the art display box 500 aligned. The back panel 112 may be inserted in along the guides (e.g., guides 128) into the art display box 500. In aspects, the back panel 112 may be inserted into the art display box 500 vertically (e.g., from the top or bottom). Alternatively, the back panel 112 may be inserted into the art display box 500 horizontally (e.g., from the right or left sides). The back panel 112 may comprise one or more hooks 106 to hang the art display box 500.

FIG. 6 illustrates an example of an information card 114 for the artwork in accordance with aspects of the present disclosure. The information card 114 includes a description of the artwork inside the art display box 400, for example. The information card 114 may indicate products and processes used to create pieces of the artwork. Additionally or alternatively, the information card 114 may indicate a story of the designer's interpretations of the artwork, such as a theme or impression. In the example of nail art, a set of ten pieces of the designed artwork may describe a story, for example. In aspects, the information card 114 may be placed on the back of the mounting plate 116, facing toward the back panel 112 of the art display box 100. This way, since the back panel 112 is transparent, the information card 114 is visible through the back panel 112.

FIG. 7 illustrates an example method of using the art display box, in accordance with aspects of the present disclosure. A general order of the operations for the method 700 is shown in FIG. 7. Generally, the method 700 starts with a start operation 702 and ends with an end operation 716. The method 700 may include more or fewer steps or may arrange ordering of the steps differently than those shown in FIG. 7. The method 700 is directed to placing pieces of the artwork in the art display box. Hereinafter, the method 700 shall be explained with reference to the systems, component, devices, modules, methods, etc., described in conjunction with FIGS. 1-6.

Orient operation 704 places the art display box in an orientation with the front surface of the front panel down. This way, an exterior surface of the back panel of the art display box is facing up.

Remove operation 706 removes the back panel from the art display box. With the art display box in the above-described orientation (e.g., with the front panel facing down, the back panel may be removed from the art display box by sliding the back panel along the guides in a horizontal direction, toward the bottom or top panel of the art display box, for example. The direction of sliding the back panel is not limited to sliding the back panel toward the bottom or top panel of the art display box but depends upon placement of the guides along interior surface of the side panels. Once the back panel is removed, the art display box is open from the backside. In some other aspects, the back panel may be removed by snapping out from the side panels with tabs or protruding objects.

Insert operation 708 inserts the mounting plate into the art display box. In aspects, the mounting plate includes pieces of the artwork attached using magnets. Holding the mounting plate facing down (e.g., with the artwork facing the front panel), the mounting plate may be placed on stoppers such that the pieces of the artwork fit into the space inside the art display box without touching any of interior surfaces of the side panels or the front panel. The mounting plate rests on the stoppers along interior surfaces of the side panels to prevent the mounting plate holding the artwork from falling onto the interior surface of the front panel.

Attach operation 710 places the information card, facing up, on the backside of the mounting plate. The writings and drawings on the information card may be visible on the backside of the mounting plate as the information card is attached. This way, the information card is visible from the back view through the back panel of the art display box.

Replace operation 712 replaces the back panel on the art display box. In aspects, the back panel may be replaced by sliding the back panel along the guides on the interior surfaces of the side panels. The back panel may be slid in from the top of the art display box along the guides or concave paths on the left panel and the right panel, for example. The present disclosure does not limit locations of the guides to be on the left panel and the right panel, however. The guides may be configured to enable the back panel to slide in other directions. In yet some other aspects, the back panel may be placed by snapping into the side panels. After replacing the back panel, the information card and the mounting plate are secured between the back panel and the stoppers.

Orient operation 714 orients the art display box with the front panel facing up. In this case, the artwork affixed to the mounting plate is viewable through the front panel. Should the designer wish to hang or display the art display box on a table, the art display box may be further oriented in a portrait or landscape orientation, for example. At end operation 716, the art display box may be arranged for private display, public display, or displayed for a competition, for instance.

As should be appreciated, operations 702-716 are described for purposes of illustrating the present methods and systems and are not intended to limit the disclosure to a particular sequence of steps, e.g., steps may be performed in different order, additional steps may be performed, and disclosed steps may be excluded without departing from the present disclosure.

The description and illustration of one or more aspects provided in this application are not intended to limit or restrict the scope of the disclosure as claimed in any way. The aspects, examples, and details provided in this application are considered sufficient to convey possession and enable others to make and use the best mode of claimed disclosure. The claimed disclosure should not be construed as being limited to any aspect, for example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate aspects falling within the spirit of the broader aspects of the general inventive concept embodied in this application that do not depart from the broader scope of the claimed disclosure.

As will be understood from the foregoing disclosure, one aspect of the technology relates to an apparatus for storing one or more piece of artwork. The apparatus comprises a front panel, the front panel being transparent; a set of side panels, the set of side panels being transparent, each of the set of side panels joined along edges to at least two other side panels and the front panel, the interior surfaces of at least two side panels on opposing sides including guides; a plurality of stoppers affixed on aside interior surfaces at two or more side joints between adjoining side panels of the set of side panels, each stopper positioned at a distance from a front interior surface of the front panel; a mounting plate, the mounting plate positioned against the plurality of stoppers to create a predetermined gap between the mounting plate and an interior surface of the front panel, the mounting plate configured for securely and removably affixing one or more pieces of artwork; and a back panel, the back panel slidable along the guides to enclose the apparatus, the back panel being transparent. The apparatus further comprises a sheet positioned between the mounting plate and the back panel, the sheet visible through the back panel of the apparatus. The mounting plate is opaque. The securely and removably affixing the one or more pieces of artwork further comprises the mounting plate being at least partially magnetized; and the one or more pieces of artwork being at least partially magnetized for securely and removably affixing the one or more pieces of artwork on the mounting plate. The set of side panels comprises four side panels. The mounting plate is flat and flush, and is configured to securely hold the one or more pieces of artwork when the apparatus is in any orientation. The front panel, the set of side panels, and the back panel are made of an acrylic material. The stoppers are made of an acrylic material. The mounting plate is configured to securely hold the one or more pieces of artwork when the apparatus is being transported. The the mounting plate is transparent.

Another aspect of the technology relates to a method of using an art display box. The method comprises orienting the art display box with a front panel facing down; removing a back panel by sliding the back panel in a first direction along at least one guide on a first side panel of the art display box; inserting a mounting plate having one or more pieces of art affixed to a mounting surface, wherein the mounting plate is inserted with the mounting surface oriented toward an interior surface of the front panel, and wherein the mounting plate is positioned against at least one stopper at a joint between at least the first side panel and a second side panels to create a predetermined gap between the mounting surface of the mounting plate and the interior surface of the front panel; replacing the back panel by sliding the back panel in a second direction along at least the guide on the first side panel of the art display box, wherein the second direction is opposite the first direction; and orienting the art display box with the front panel facing up, wherein the one or more pieces of artwork are visible through the front panel. The method further comprises placing a sheet on a back surface of the mounting plate, the back surface opposite the mounting surface of the mounting plate, the sheet being visible through the back panel of an assembled art display box. The back panel includes a hook on an exterior surface for hanging the art display box. The mounting plate is configured to securely hold the one or more pieces of artwork when the apparatus is in any orientation. The front panel, the first side panel, the second side panel, and the back panel are made of acrylic material.

In another aspect, the technology relates to an art display box. The box comprises a front panel, the front panel being transparent; a set of side panels, the set of side panels being transparent, each of the set of side panels joined along edges to at least two other side panels and the front panel, the interior surfaces of at least two side panels on opposing sides including guides; a plurality of stoppers affixed on side interior surfaces at two or more side joints between adjoining side panels of the set of side panels, each stopper positioned at a distance from a front interior surface of the front panel; a mounting plate, the mounting plate positioned against the plurality of stoppers to create a predetermined gap between the mounting plate and an interior surface of the front panel, the mounting plate comprising a magnetized material for securely and removably affixing one or more pieces of artwork; and a back panel, the back panel slidable along the guides to enclose the apparatus, the back panel being transparent. The box further comprises a sheet positioned between the mounting plate and the back panel, the sheet visible through the back panel. The one or more pieces of artwork are at least partially magnetized. The mounting plate is transparent. The mounting plate is opaque.

Any of the one or more above aspects in combination with any other of the one or more aspect. Any of the one or more aspects as described herein.

What is claimed is:

1. An apparatus for storing one or more pieces of artwork, the apparatus comprising:

a front panel, the front panel being transparent;

a set of side panels, the set of side panels being transparent, each of the set of side panels joined along edges to at least two other side panels and the front panel, and an interior surface of each of at least two side panels on opposing sides comprising a guide;

a plurality of stoppers affixed on interior surfaces of the set of side panels;

a mounting plate, the mounting plate positioned against the plurality of stoppers to create a predetermined gap between the mounting plate and the interior surface of the front panel, the mounting plate configured for removably affixing the one or more pieces of artwork, wherein the mounting plate is configured to magnetically couple with a base associated with the one or more pieces of artwork; and a back panel for enclosing the apparatus using the guides, and the back panel being transparent to enable viewing at least a part of a back surface of the mounting plate through the back panel.

2. The apparatus according to claim 1, the apparatus further comprising:

a sheet positioned between the mounting plate and the back panel, wherein the sheet is visible through the back panel of the apparatus.

3. The apparatus according to claim 1, wherein the mounting plate is opaque.

4. The apparatus according to claim 1, wherein the mounting plate comprises a magnetized material.

5. The apparatus according to claim 1, wherein the set of side panels comprises four side panels.

6. The apparatus according to claim 1, wherein the mounting plate is flat and flush, and is configured for securely holding the one or more pieces of artwork when the apparatus is in any orientation.

7. The apparatus according to claim 1, wherein the front panel, the set of side panels, and the back panel are made of an acrylic material.

8. The apparatus according to claim 1, wherein at least one of the plurality of stoppers are made of an acrylic material.

9. The apparatus according to claim 1, wherein the mounting plate is configured to securely hold the one or more pieces of artwork when the apparatus is being transported.

10. The apparatus according to claim 1, wherein the mounting plate is transparent.

11. A method of using an art display box, the method comprising:

orienting the art display box with a front panel facing down, wherein the front panel is positioned below a back panel;

removing the back panel by sliding the back panel in a first direction along at least one guide on a first side panel of the art display box;

inserting a mounting plate, wherein the mounting plate comprises a mounting surface configured to couple with a base associated with one or more pieces of artwork, wherein the mounting plate is inserted with the mounting surface oriented toward an interior surface of the front panel, wherein the mounting plate is positioned against a plurality of stoppers, a respective stopper of the plurality of stopper is positioned at a joint between at least the first side panel and a second side panel to create a predetermined gap between the mounting surface of the mounting plate and the interior surface of the front panel, and wherein the predetermined gap is configured for preventing the one or more pieces of artwork, when installed, from touching the interior surface of the front panel, wherein the mounting plate is configured to securely hold the one or more pieces of artwork when the art display box is in any orientation;

replacing the back panel by sliding the back panel in a second direction along the at least one guide on the first side panel of the art display box, wherein the second direction is opposite the first direction; and orienting the art display box in a position such that the one or more pieces of artwork are visible through the front panel.

12. The method of claim 11, the method further comprising:

placing a sheet on a back surface of the mounting plate, the back surface opposite the mounting surface of the mounting plate, wherein the sheet is visible through the back panel of an assembled art display box.

13. The method of claim 11, wherein the front panel, the first side panel, the second side panel, and the back panel are made of acrylic material.

14. An art display box, comprising:

a front panel, the front panel being transparent;

a set of side panels, the set of side panels being transparent, each of the set of side panels joined along edges to at least two other side panels and the front panel, and an interior surface of each of at least two side panels on opposing sides comprising a guide;

a plurality of stoppers affixed on interior surfaces of the set of side panels;

a mounting plate, the mounting plate positioned against the plurality of stoppers to create a predetermined gap between the mounting plate and the interior surface of the front panel, the mounting plate configured for removably affixing one or more pieces of artwork, wherein the mounting plate is configured to magnetically couple with a base associated with the one or more pieces of artwork; and a back panel for enclosing the art display box using the guides, and the back panel being transparent to enable viewing at least a part of a back surface of the mounting plate through the back panel.

15. The art display box of claim 14, further comprising:

a sheet positioned between the mounting plate and the back panel, wherein the sheet is visible through the back panel.

16. The art display box of claim 14, wherein the mounting plate is opaque.

17. The art display box of claim 14, wherein the mounting plate comprises a magnetized material.

18. The art display box of claim 14, wherein the set of side panels comprises four side panels.

19. The art display box of claim 14, wherein the mounting plate is configured to securely hold the one or more pieces of artwork when the art display box is being transported.

* * * * *